US009915248B2

(12) United States Patent
Hansen

(10) Patent No.: US 9,915,248 B2
(45) Date of Patent: Mar. 13, 2018

(54) HYDRAULIC PISTON MACHINE, IN PARTICULAR WATER HYDRAULIC MACHINE

(75) Inventor: Ove Thorboel Hansen, Nordborg (DK)

(73) Assignee: DANFOSS A/S, Nordborg (DK)

( * ) Notice: Subject to any disclaimer, the term of this patent is extended or adjusted under 35 U.S.C. 154(b) by 1316 days.

(21) Appl. No.: 12/958,794

(22) Filed: Dec. 2, 2010

(65) Prior Publication Data

US 2011/0135507 A1 Jun. 9, 2011

(30) Foreign Application Priority Data

Dec. 3, 2009 (DE) ..... 10 2009 056 903

(51) Int. Cl.
*F04B 1/12* (2006.01)
*F04B 1/20* (2006.01)
*F01B 3/00* (2006.01)

(52) U.S. Cl.
CPC ..... *F04B 1/124* (2013.01); *F04B 1/2014* (2013.01); *F01B 3/0085* (2013.01)

(58) Field of Classification Search
CPC ..... F16J 1/006; F04B 1/124; F04B 1/2014; F01B 3/0085
USPC ..... 92/259, 255, 248, 249, 172, 71, 57, 92/181 R; 91/488
See application file for complete search history.

(56) References Cited

U.S. PATENT DOCUMENTS 3,187,644 A * 6/1965 Ricketts ..... 92/248
3,277,834 A * 10/1966 Eickmann ..... 92/58
3,319,575 A 5/1967 Havens
3,633,467 A * 1/1972 Watanabe et al. ..... 92/172
3,707,113 A * 12/1972 Hein et al. ..... 92/248
3,741,077 A * 6/1973 Hulsebus et al. ..... 92/57
3,896,707 A 7/1975 Holmstrom
3,915,074 A * 10/1975 Bristow et al. ..... 92/172
3,984,903 A 10/1976 Murayama et al.
3,984,904 A * 10/1976 Schlecht ..... 29/888.051
3,986,439 A * 10/1976 Ring ..... 92/158
3,999,468 A * 12/1976 Bristow et al. ..... 92/248
4,191,095 A * 3/1980 Heyl ..... 92/78
(Continued)

FOREIGN PATENT DOCUMENTS

DE 1920140 9/1970
DE 7108800 7/1971
(Continued)

*Primary Examiner* — Nathaniel Wiehe
*Assistant Examiner* — Michael Quandt
(74) *Attorney, Agent, or Firm* — McCormick, Paulding & Huber LLP

(57) ABSTRACT

The invention concerns a hydraulic piston machine, in particular a water hydraulic machine, with at least one cylinder, in which a piston (4) is arranged to reciprocate, the piston (4) comprising a hollow that is surrounded by an annular wall and has one open end. It is endeavored to keep cavitations small. For this purpose, a filling member (13) is arranged in the hollow (12), the filling member (13) having at least a radial projection (22) and the annular wall (16) having at least a radial depression (17) in the inside facing the hollow (12), or the annular wall (16) having a radial projection and the filing member (13) having a radial depression, the depression having a restraint (19), at least at the end adjacent to the open end (18) of the hollow (12), and the projection (22) and the depression (17) engaging each other.

10 Claims, 2 Drawing Sheets

(56) References Cited

U.S. PATENT DOCUMENTS

| | | | | | |
|---|---|---|---|---|---|
| 4,519,300 | A | * | 5/1985 | Adomis et al. | 92/158 |
| 5,007,332 | A | * | 4/1991 | Wagenseil | 92/181 R |
| 5,072,655 | A | * | 12/1991 | Adler | 92/160 |
| 5,076,148 | A | * | 12/1991 | Adler | 92/158 |
| 5,216,943 | A | | 6/1993 | Adler et al. | |
| 5,233,912 | A | * | 8/1993 | Mueller | 92/29 |
| 5,265,331 | A | | 11/1993 | Engel et al. | |
| 5,487,206 | A | * | 1/1996 | Brown et al. | 16/52 |
| 5,490,446 | A | * | 2/1996 | Engel | 92/157 |
| 5,553,378 | A | | 9/1996 | Parekh et al. | |
| 5,642,654 | A | | 7/1997 | Parekh et al. | |
| 5,940,446 | A | | 8/1999 | Mackenthun | |
| 6,250,206 | B1 | | 6/2001 | Johnson | |
| 6,318,242 | B1 | | 11/2001 | Stoppek | |
| 6,662,709 | B1 | | 12/2003 | Beutler | |
| 6,732,633 | B1 | | 5/2004 | Betz | |
| 6,840,696 | B1 | * | 1/2005 | Donders | 403/122 |
| 6,994,014 | B2 | | 2/2006 | Rober et al. | |
| 7,263,925 | B1 | | 9/2007 | Hansen et al. | |
| 7,650,829 | B2 | | 1/2010 | Beck | |
| 2009/0139396 | A1 | * | 6/2009 | Terauchi | 92/12.2 |

FOREIGN PATENT DOCUMENTS

| | | | |
|---|---|---|---|
| DE | 2261903 | | 6/1974 |
| DE | 25 52 256 | A1 | 5/1976 |
| DE | 8509011.5 | U1 | 12/1986 |
| DE | 3732648 | A1 | 4/1989 |
| DE | 3804424 | C1 | 8/1989 |
| DE | 3912213 | C1 | 10/1990 |
| DE | 3919329 | C1 | 12/1990 |
| DE | 10341791 | A1 | 4/2005 |
| DE | 102004043745 | B3 | 2/2006 |
| DE | 102006060015 | A1 | 6/2008 |
| EP | 0309728 | A2 | 4/1989 |
| EP | 0832356 | B1 | 4/1998 |
| EP | 1336756 | A2 | 8/2003 |
| EP | 1378628 | A1 | 1/2004 |
| GB | 1159086 | A | 7/1969 |
| JP | 10331759 | A | 12/1998 |
| WO | 8303650 | A1 | 10/1983 |
| WO | 9641953 | A1 | 12/1996 |
| WO | 2008074499 | A1 | 6/2008 |

* cited by examiner

HYDRAULIC PISTON MACHINE, IN PARTICULAR WATER HYDRAULIC MACHINE

CROSS REFERENCE TO RELATED APPLICATIONS

Applicant hereby claims foreign priority benefits under U.S.C. § 119 from German Patent Application No. 10 2009 056 903.0 filed on Dec. 3, 2009, the contents of which are incorporated by reference herein.

TECHNICAL FIELD

The invention concerns a hydraulic piston machine, in particular a water hydraulic machine, with at least one cylinder, in which a piston is arranged to reciprocate, the piston comprising a hollow that is surrounded by an annular wall and has one open end.

BACKGROUND OF THE INVENTION

Such a piston machine is known from DE 10 2004 043 745 B3.

The hollow of the piston is advantageous, as it reduces the mass of the piston, when compared to a massive piston. When, however, such a piston machine is used as a pump for water, it can be observed that cavitations occur in the hollow. It is assumed that the underpressure gets too large, as the fluid cannot be moved fast enough.

SUMMARY OF THE INVENTION

The invention is based on the task of keeping cavitations small.

With a hydraulic piston machine as mentioned in the introduction, this task is solved in that a filling member is arranged in the hollow, the filling member having at least a radial projection and the annular wall having at least a radial depression in the inside facing the hollow, or the annular wall having a radial projection and the filing member having a radial depression, the depression having a restraint, at least at the end adjacent to the open end of the hollow, and the projection and the depression engaging each other.

This embodiment permits the use of a filling member inside the piston, which will, in the ideal case, prevent liquid, in particular water, from entering the hollow and causing cavitations in connection with occurring underpressures. However, already a reduction of the amount of water entering the hollow will reduce the cavitations. The special adaptation of piston and filling member to one another makes the manufacturing simple. The filling member can simply be pressed into the piston. After insertion of the filling member into the piston, the filling member is held in the piston by means of form-fit, without requiring further fixing elements. In particular in connection with water as hydraulic fluid, fixing elements of metal tend to cause problems. They suffer from corrosion and after a certain operation duration they may even loose their holding ability.

The use of a filling member in the piston is known in connection with oil hydraulic machines. Here, however, the compressibility is usually larger. Thus, also the losses get larger and with oil hydraulic machines, it is endeavored to reduce the dead volume by means of the filling member. Examples are, for example, shown in U.S. Pat. No. 5,007, 332, where a cup spring is used to fix the filling member. As mentioned above, however, such a cup spring is in danger of getting corroded.

From U.S. Pat. No. 5,072,655 it is known to provide the piston with a radially inwardly projecting shoulder that engages an annular groove in the filling member. This, however, changes the piston wall, so that under certain circumstances it may be difficult to obtain the required tightness.

With an embodiment according to DE 71 08 800 U1 the piston wall at the open end of the hollow is flared towards the inside. This also requires a deformation of the piston, which may have a negative effect on the running features and the operation properties of the machine.

Preferably, the depression is continuous in the circumferential direction. In this case, it is not required to consider an angular alignment of piston and filling member when inserting the filling member into the hollow.

Further, it is advantageous, when the projection is uninterrupted in the circumferential direction. In this case, the whole circumference of the filling member is used to provide the desired holding force for the filling member in the piston.

Preferably, the restraint is made as a step. Such a step provides sufficient resistance against a movement of the filling member out of the piston. The projection of the filling member bears on the step, thus preventing an outward movement of the filling member. The same applies, when the projection has been made on the annular wall.

Preferably, the step encloses an angle of at least 90° with the axis of the piston. The step can also be slightly inclined, so that the radial inner end of the step can dig into the filling member, when the filling member is inserted into the hollow of the piston.

Preferably, the free end of the hollow has a conical bulge. This simplifies the insertion of the filling member. The conical bulge causes that at least the projection of the filling member is compressed radially during insertion into the hollow. As soon as the hollow reaches the depression, the projection can expand radially again, and the filling member is held in the piston by means of form-fit.

Preferably, the projection, together with the end of the filling member adjacent to the free end of the hollow, forms a common front face. Thus, on this front face the filling member has not step. The consequence of this is that after the insertion the filling member is somewhat recessed in relation to the open end of the piston. However, when inserting the filling member into the piston the required forces can be applied to the filling member over a relatively large cross-sectional face, so that the risk of damaging the filling member during the insertion is small.

Preferably, the radial extension of the projection amounts to maximum 5%, in particular maximum 3% and preferably maximum 2.5% of the filling member diameter. A radial extension of a few percent will be sufficient to hold the filling member securely in the hollow. Usually, the forces acting upon the filling member will also be manageable with radially relatively small projections.

Preferably, in relation to the depression the projection has an undersize in the axial direction and an oversize in the radial direction, as long as the piston and the filling member are separated. In this case, the projection can no longer expand completely in the radial direction, when, during insertion of the filling member into the hollow, it reaches the depression. The "surplus" volume of the projection then expands in the axial direction, where volume is still available because of the undersize. In this manner, it can be ensured that the projection also fills the depression completely in the axial direction, so that in the axial direction the filling member is held without clearance in the piston.

Preferably, the depression has a bottom that encloses an acute angle with a parallel to the axis of the piston, several depressions being arranged in series parallel to the axis of the piston. In this case, it may be expedient for the projection to be longer in the axial direction than a depression. The sequence of the depressions forms a fir-like structure, into which the projection is pressed. This results in relatively many holding steps, which then hold the filling member reliably in the hollow of the piston.

BRIEF DESCRIPTION OF THE DRAWINGS

In the following, the invention is described on the basis of preferred embodiments in connection with the drawings, showing.

DETAILED DESCRIPTION OF THE PREFERRED EMBODIMENT

Figure 1:
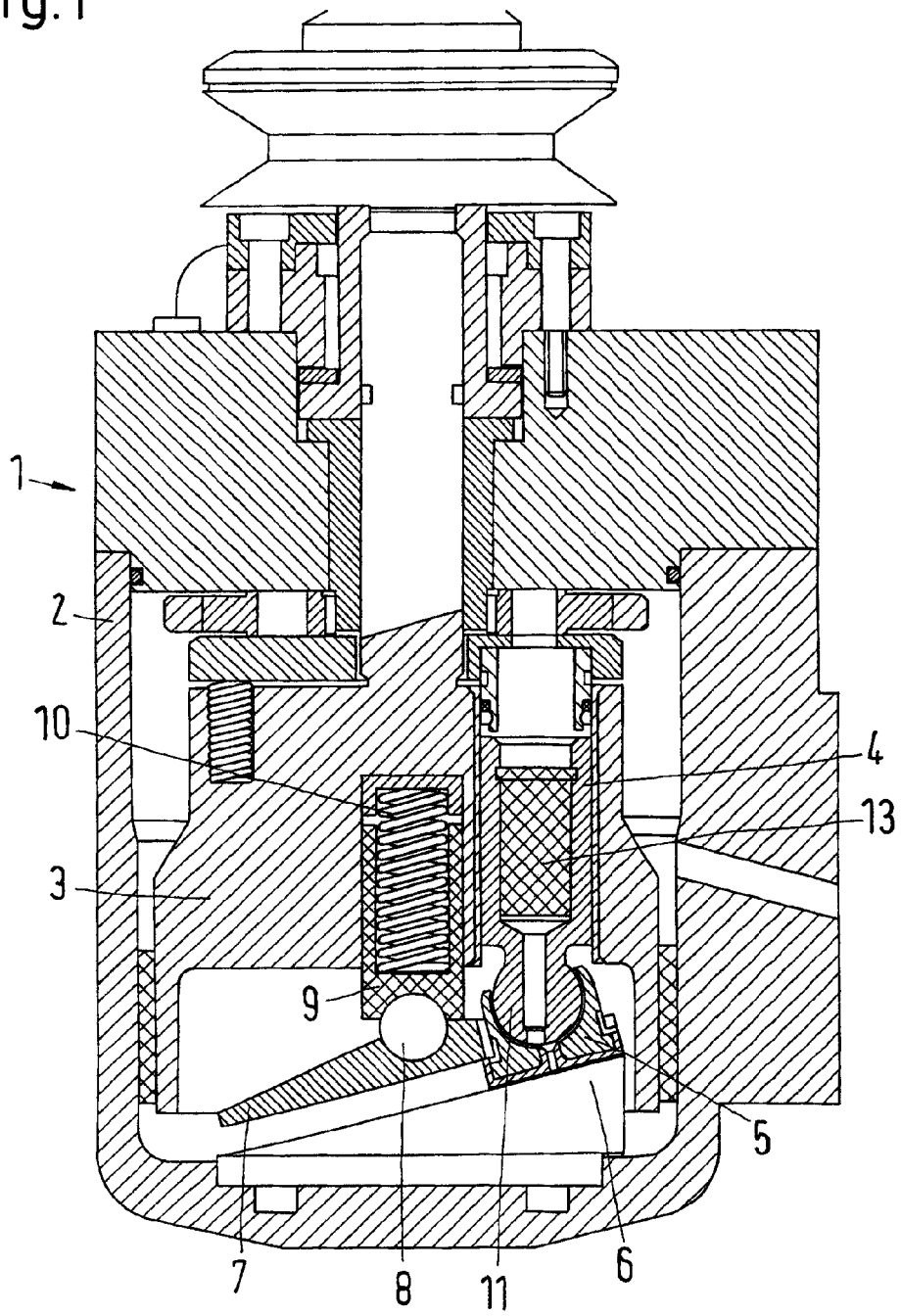
FIG. 1 is a strictly schematic view of a hydraulic axial piston machine

A hydraulic axial piston machine 1 comprises a cylinder drum 3 that is arranged to be rotatable in a housing 2. In the cylinder drum 3, pistons 4 are arranged to be movable in the axial direction. Only one piston 4 is visible. All other pistons are located outside the sectional plane. The pistons 4 are guided on a wobble plate 6 by means of a slide shoe 5. A pressure plate 7 holds the slide shoe 5 in a bearing position against the wobble plate 6. Via a ball 8, the pressure plate bears on one end of a pressure piston 9 that is accommodated in the cylinder drum. The pressure piston 9 is acted upon in the axial direction by a spring 10, meaning that it is pressed in the direction of the wobble plate 6.

Preferably, the piston 4 is made of stainless steel. In dependence of the conditions, under which the machine will be used, in particular the pressures, media and designs, also other materials can be used, in particular plastic.

As known per se, a rotation of the cylinder drum 3 causes a reciprocating movement of the pistons 4 in the axial direction. As the pressure plate 7 must always remain parallel to the wobble plate 6, it performs a continuous tilting movement in relation to the cylinder drum 3. In this connection, the ball 8 provides an articulated connection between the pressure plate 7 and the cylinder drum 3. Each slide shoe 5 tilts around a ball 11 that is arranged on the end of the piston 4 protruding from the cylinder drum 3.

The machine 1 is operated with water as hydraulic fluid. It must also have a high output when working as a pump. Volumes of 30 $m^3$/h and higher are considered to be high outputs. However, in such applications, problems may arise in that cavitations occur in the piston 4, which comprises a hollow 12 (FIG. 2*b*) with the purpose of saving weight, as the underpressure gets too large, because the fluid cannot move fast enough. For this reason, a filling member 13, also called filling piece, is arranged in the hollow 12 of the piston 4. The explanation below concerns the FIGS. 2 and 3. However, it must be noted that such problems do no only occur in connection with axial piston machines, but also with radial piston machines, and basically with all hydraulic machines, in which pistons are arranged to reciprocate in particular machines, in which water is used as hydraulic fluid.

Figure 2A:
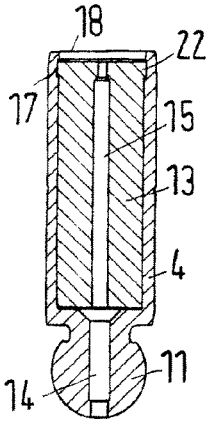
FIG. 2 is a first embodiment of a piston with a filling member.
Figure 2B:
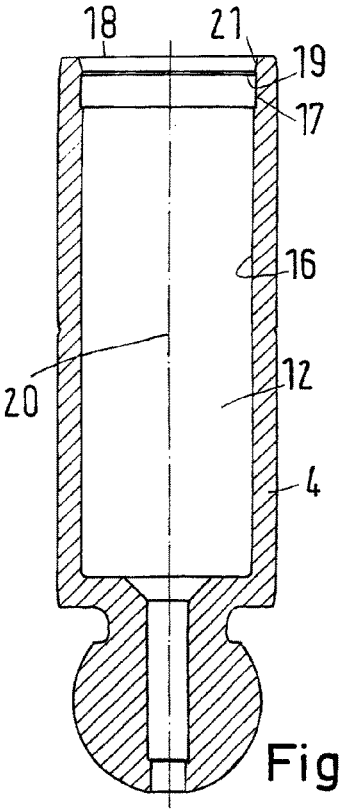

FIG. 2*a* shows the piston 4 with the filling member 14 inserted into the hollow 12 and the ball 11. A channel 14 passes through the ball 11 and ends in the hollow 12. Through this channel fluid is supplied to the contact face between the slide shoe 5 and the ball 11. In order to maintain this fluid supply that serves for lubrication, also with inserted filling member 13, the filling member 13 has a through channel 15. However, the channel 15 must not necessarily be arranged centrally, as shown. It can also be arranged outside of an axis 20 of the piston 4 or be formed by a free space that is formed between the filling member 13 and the inner wall 16. Such a free space can, for example, be formed by an axial groove in the filling member 13 and/or in the inner wall 16.

The filling member 13 is made of a plastic material, for example of polypropylene. Also another plastic material can be used for the filling member 13, in particular a plastic material that is volume constant.

In the inner wall 16 of the hollow 12, the piston 4 has a preferably circumferential depression 17 in the form of a groove that has a restraint 19 in the form of a step at the end adjacent to the open end 18 of the hollow. For example, the step extends at right angles to the axis 20 of the piston 4. However, it can also enclose an acute angle with the axis in such a manner that an undercut appears.

At its open end 18, the hollow 12 opens with a cone face 21. Together with the axis 20, the cone face 21 encloses an angle of, for example, 10 to 20°, in particular 10 to 15°. The difference between the smallest diameter and the largest diameter of the cone face 21 is larger than the radial extension of the depression 17.

Figure 2C:
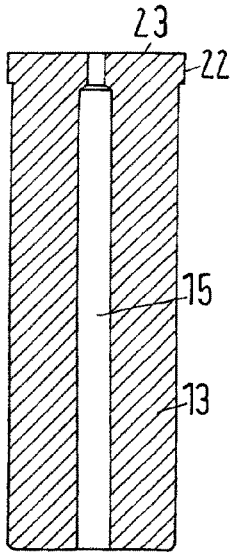

The filling member 13, shown in enlarged form in FIG. 2*c*, comprises a radial projection 22 with a front face 23 adjacent to the open end 18 of the hollow 12. The front face 23 ends in alignment with the projection 22. Preferably, the projection 22 is circumferential. When the channel 15 is made as a groove in the filling member 13, the projection 22 is interrupted here. The axial extension of the projection 22 is somewhat smaller than the axial extension of the depression 17, that is, in the axial direction the projection 22 has an undersize in relation to the depression 17.

In the radial direction, the projection 22 has an extension that is somewhat larger than the radial extension of the depression 17. In other words, in the radial direction the projection 22 has an oversize in relation to the depression 17. However, this only applies for as long as the filling member 13 is separated from the piston 4. Otherwise, the filling member 13 has an outer diameter, which practically corresponds to the inner diameter of the hollow 12, so that the filling member 13 can be inserted into the hollow 12 of the piston 4 without problems. A small clearance is permissible, so that the filling member 13 can be moved into the piston 4.

When the filling member 13 has been inserted so far into the piston 4 that the projection 22 bears on the cone face 21, a further pressing force will cause a compression of the projection in the radial direction. When the filling member 13 is pushed further and the projection 22 overlaps the depression 17, the projection 22 can expand again. However, it cannot expand to its original radial size, as the somewhat smaller radial extension of the depression 17 does not permit this. The material that is somehow "in excess" will then expand in the axial direction, meaning that the projection 22 fills the depression 17 completely in the axial direction. In the area of the depression 17, the filling member 13 is then held by means of form-fit in the piston 4, both in the axial direction and in the radial direction. Thus, there is no risk that the filling member 13 is detached from the piston 4.

In a manner not shown in detail, the location of the depression 17 and the projection 22 can be exchanged, so that the depression 17 is arranged in the circumferential wall of the filling member 13 and the projection 22 is arranged in the radial inside of the circumferential wall 16. The effect is practically the same.

Figure 3A:
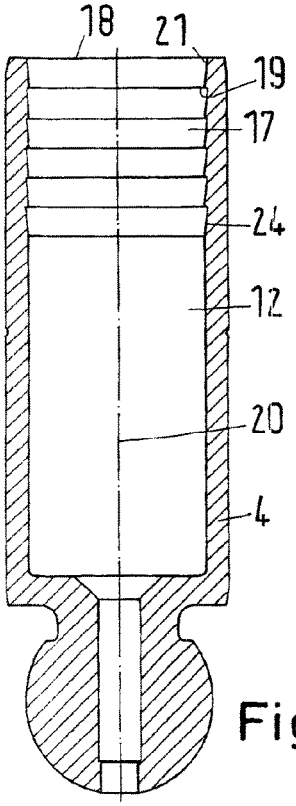
FIG. 3 is a second embodiment of a piston with a filling member.
Figure 3B:
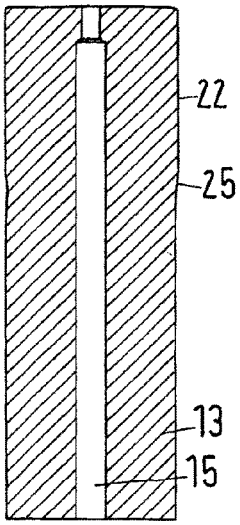

FIG. 3 shows a modified embodiment. Here, several depressions 17 are provided parallel to the axis 20 in a series one after the other. Each depression 17 has a bottom 24 that encloses an acute angle with the axis 20. At the end facing away from their open end 18, each depression 17 has practically the inner diameter of the hollow 12.

The filling member 13 comprises a projection 22 that is also circumferential and having on its end facing away from the open end 18 a cone section 25. The cone angle of the cone section 25 can be exactly as large as the cone angle of the cone face 21. However, it can also be smaller.

In the embodiment of the piston 4 according to FIG. 3*a*, the depressions 17 form a fir-like structure. When the filling member 13 is pressed into the hollow 12, a number of zigzag-like depressions appear in the projection 22, so that also here the filling member 13 is held in the piston 4 by means of form-fit. Each depression 17 also has a restraint 19 in the form of a step, the height of the step being relatively small, also here.

In all cases, the projection 17 has a radial extension that is maximum 5%, preferably even less, namely, for example, maximum 3% or even maximum 2.5%, of the diameter of the filling member 13. A larger radial extension gives practically no additional advantages.

While the present invention has been illustrated and described with respect to a particular embodiment thereof, it should be appreciated by those of ordinary skill in the art that various modifications to this invention may be made without departing from the spirit and scope of the present.

What is claimed is:

1. A hydraulic piston machine comprising:

at least one cylinder in which a piston is arranged to reciprocate;

the piston comprising:

an annular wall defining a hollow and one open end; and a filling member of a plastic material configured to be inserted into the hollow;

wherein the filling member has at least a radial projection and the annular wall has at least a radial depression in the inside facing the hollow, the radial projection being larger than the radial depression in a radial direction when the filling member is not inserted into the hollow;

wherein the depression has a restraint adjacent to the open end of the hollow;

wherein the projection and the depression are configured to engage each other;

wherein the projection is configured to compress in the radial direction when the filling member is inserted in the hollow of the piston and the projection contacts the annular wall; and wherein the projection is configured to expand in the radial direction into the depression when the filling member is inserted into hollow of the piston and the projection overlaps the depression.

2. The machine according to claim 1, wherein the depression is circumferential.

3. The machine according to claim 2, wherein the projection is uninterrupted in the circumferential direction.

4. The machine according to claim 1, wherein the restraint is made as a step.

5. The machine according to claim 4, wherein the step encloses an angle of at least 90° with the axis of the piston.

6. The machine according to claim 1, wherein the free end of the hollow forms a conical bulge.

7. The machine according to claim 1, wherein the projection, together with the end of the filling member adjacent to the free end of the hollow, forms a common front face.

8. The machine according to claim 1, wherein the radial extension of the projection amounts to maximum 5% of the filling member diameter.

9. The machine according to claim 1, wherein the radial projection is smaller than the radial depression in an axial direction when the filling member is not inserted into the hollow.

10. The machine according to claim 1, wherein the depression has a bottom that encloses an acute angle with a parallel to the axis of the piston, several depressions being arranged in series parallel to the axis of the piston.

* * * * *